United States Patent [19]

Schoenauer

[11] Patent Number: 4,852,609

[45] Date of Patent: Aug. 1, 1989

[54] SUMP PUMP ADAPTOR

[76] Inventor: Anton Schoenauer, 502 E. Ironwood, Mt. Prospect, Ill. 60056

[21] Appl. No.: 266,875

[22] Filed: Nov. 3, 1988

[51] Int. Cl.[4] ..... E03B 5/00; F04B 49/04

[52] U.S. Cl. ..... 137/565; 137/590; 137/593; 137/236.1; 137/362; 417/40

[58] Field of Search ..... 137/565, 590, 592, 593, 137/236.1, 362; 417/40

[56] References Cited

U.S. PATENT DOCUMENTS

| | | | |
|---|---|---|---|
| 382,188 | 5/1888 | Pitt | 137/236.1 |
| 695,312 | 3/1902 | Hickey | 137/362 |
| 1,700,636 | 1/1929 | Khun | 417/40 |
| 1,762,190 | 6/1930 | Noe et al. | 137/362 |
| 1,962,978 | 6/1934 | Baldare | 137/362 |
| 2,049,340 | 7/1936 | Van Der Horst et al. | 137/362 |
| 2,327,602 | 8/1943 | Kesteloot | 137/362 |
| 2,347,544 | 4/1944 | Costa et al. | 417/40 |
| 2,421,066 | 5/1947 | Howe | 137/362 |
| 2,478,976 | 8/1949 | Modlin | 137/362 |
| 2,531,752 | 11/1950 | Thomas | 417/40 |
| 2,683,499 | 7/1954 | De Croes | 137/593 |
| 2,739,662 | 3/1956 | Sofia | 417/40 |
| 2,892,467 | 6/1959 | Weisman et al. | 137/362 |
| 2,927,174 | 3/1960 | Walshin | 417/40 |
| 2,970,605 | 2/1961 | Sargent | 137/247.41 |
| 3,020,922 | 2/1962 | Oury | 137/115 |
| 3,116,751 | 1/1964 | Hamilton | 137/593 |
| 3,196,894 | 7/1965 | Bodi | 137/236.1 |
| 3,318,248 | 5/1967 | Rembold | 417/40 |
| 3,564,041 | 1/1986 | Kramer | 137/565 |
| 4,074,684 | 2/1978 | Biesel | 137/593 |

OTHER PUBLICATIONS

Publication Sears Vertical Sump Drainer Model 390.304100 Sears Roebuck and Co., Chicago, Ill. 11/88.

*Primary Examiner*—A. Michael Chambers

*Attorney, Agent, or Firm*—Hill, Van Santen, Steadman & Simpson

[57] ABSTRACT

A sump pump adaptor which includes a tank which is mounted to a bottom nipple connected to a sewer pipe. A vertical sump pump is mounted on the tank so as to pump water from the tank out of a basement, for example as by pumping water through the basement window.

1 Claim, 2 Drawing Sheets

SUMP PUMP ADAPTOR

BACKGROUND OF THE INVENTION

1. Field of the Invention

This invention relates in general to a tank which is connected over a sewer pipe and receives water therefrom and which includes a sump pump which is actuated so as to pump water from the tank.

2. Description of the Prior Art

U.S. Pat. Nos. 2,970,607, 3,020,922, 2,892,467, 2,739,662, 2,478,976, 2,421,066, 2,347,544, 2,327,602, 2,049,340, 1,700,636, 1,962,978, 695,312 and 1,762,190 disclose various structures which are mounted in cellar drains and sewer pipes.

SUMMARY OF THE INVENTION

The present invention comprises a tank which is connected to a sewer pipe and which has a sump pump mounted therein so that when water passes from the sewer pipe into the tank the sump pump is energized to pump water from the tank out the basement window.

A standby coupler and lock nut and washers provide a fluid seal between the sewer pipe and the tank so that the water from the sewer pipe will pass into the tank.

A bracket may be mounted to the top of the tank and which is connectable to the sump pump to provide a more rigid connection between the sump pump and the tank.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
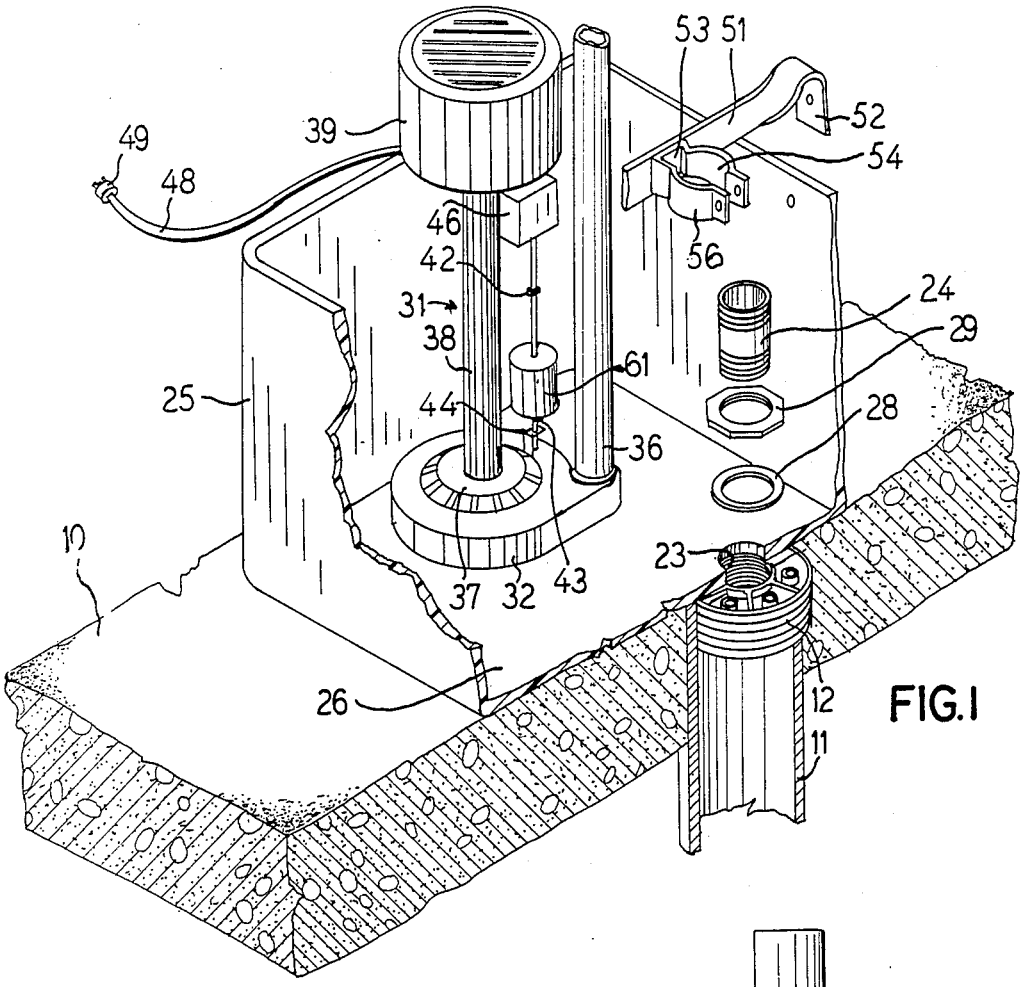
FIG. 1 is a partially cutaway perspective view of the tank and sump pump of the invention.
Figure 2:
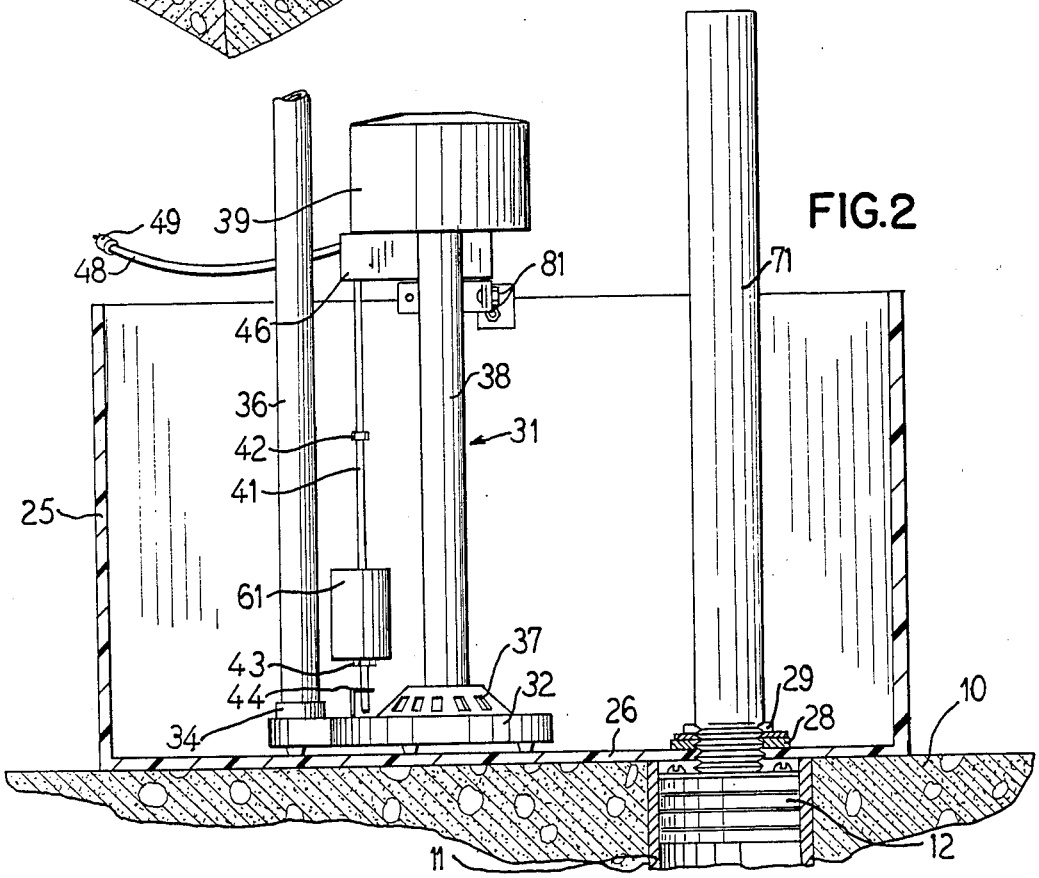
FIG. 2 is a sectional view of the invention illustrating a stand pipe connected to the sewer pipe.
Figure 4:
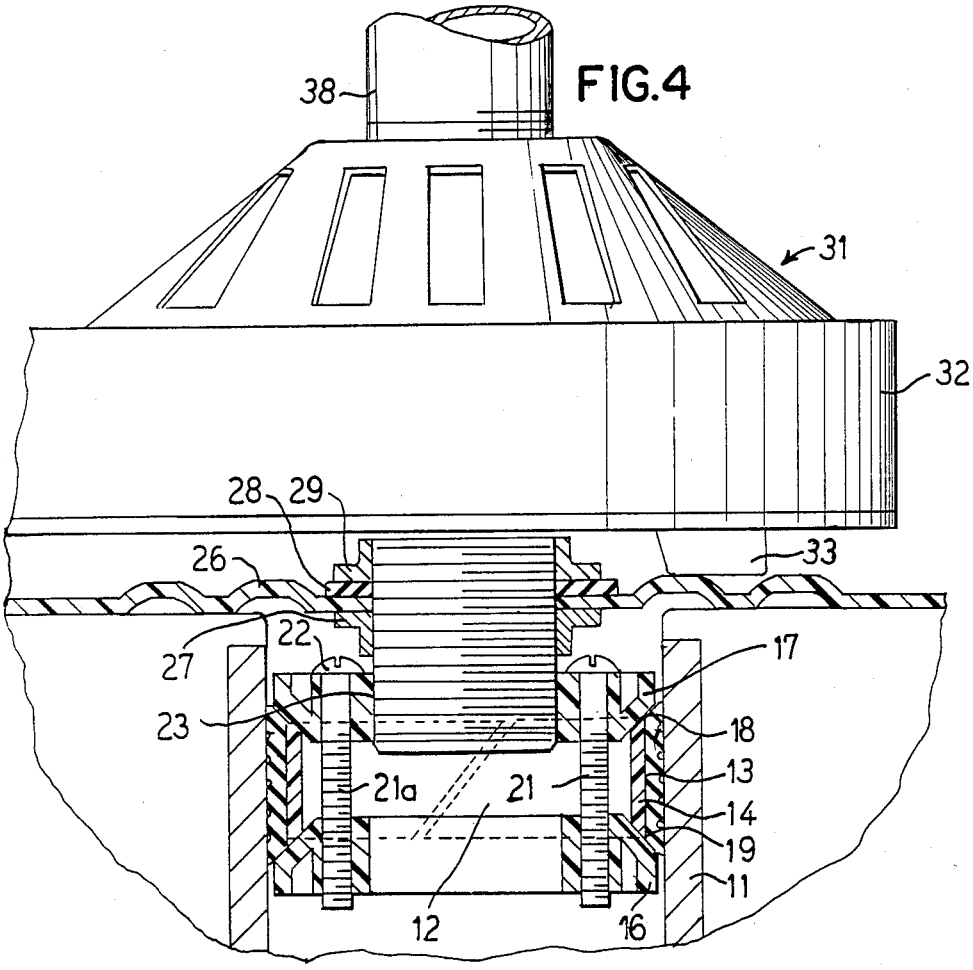
FIG. 4 is an enlarged cut-away sectional view illustrating the stand pipe coupler and the connection to the tank.

FIG. 1 illustrates a concrete basement floor 10 and a sewer pipe 11 which is mounted in the floor 10. A tank 25 has a bottom 26 which is connected to the sewer pipe with a stand pipe coupler 12 and a three inch nipple 24 which has a first threaded end which is threadedly received in threaded portion 23 of the stand pipe coupler 12. A flexible washer 28 and a threaded collar 29 are threadedly received on the nipple 24 so as to seal the bottom of the tank 26 to the stand pipe coupler 12. Standby coupler 12 is shown in greater detail in FIG. 4. The stand pipe coupler comprises a pair of opposing disk-shaped members 16 and 17 which are formed with outer tapered surfaces 18 and 19. A flexible sleeve member 13 is mounted between the members 16 and 17 in the tapered portions 18 and 19. A rigid plastic backing member 14 is formed with a break in its outer surface so that as bolts 21 and 21*a* are tightened by turning their head 22 to draw the members 16 and 17 toward each other, the member 14 will expand and move outwardly on the tapered surfaces 18 and 19 thus forcing the flexible cylindrical member 13 outwardly so that it makes a fluid seal within internal surface of the power pipe 11. The nipple 24 is then threadedly received in threaded portion 23 of the upper portion 17 and a threaded collar 27 is placed on the stand pipe 24 such that its upper surface engages the bottom of the floor 26 with a tank. Flexible gasket 28 is put over the upper end of the stand pipe 24 above the floor 26 of the tank and a threaded collar 29 is threaded onto the upper end of the nipple 24 and the bottom of the tank 26. A vertical sump pump 31 is mounted in the tank 25 and has a base 32 with feet 33 which rest on the floor 26. A discharge pipe 36 is threadedly received in portion 34 of the sump pump and discharges water from the pump out a basement window, for example. As shown in FIGS. 1 and 2, the sump pump 31 has a metallic upstanding support member 38 attached to the base 32 above fluid inlet openings 37. A pump is mounted in the base 32 and a drive shaft of the pump passes up through the hollow member 38 to a drive motor 39 which is mounted on the upper end of the member 38 as shown in FIGS. 1 and 2. Electrical power cord 48 with a plug 49 supplies power to the motor 39. A fiber glass rod 41 extends from the base 32 and is connected thereto with a bracket 44 and the upper end of the rod 41 is connected to an electrical switch 46 which energizes the motor 39. A float 61 is moveably mounted on the fiber glass rod 41 and an upper rubber bushing stop 42 is mounted on the fiber glass rod 41 above the float 61 and a lower upper housing 43 is mounted on the glass rod below the float 61. The fiber glass rod 41 is moveably mounted in the lower bracket 44 such that when the float 61 moves upwardly on the rod 41 until it engages the rubber bushing stop 42 after which it causes the fiber glass 41 rod to move upwardly as the fluid rises in the tank to a higher level, thus actuating the switch 46. When the switch 46 is actuated, the motor 39 is energized thus driving the pump through the drive shaft which is mounted in the hollow member 38 so as to inject water through the intake openings 37 and out the outlet pipe 36. When the water in the tank 25 has been reduced to a level such that the float 61 moves down and engages the lower rubber stop bushing 43, the weight of the float 61 will cause the bush rod 41 to move downwardly in the bracket 44 thus opening the switch 46 turning off the motor so that the pump will stop.

FIG. 2 illustrates a modification of the invention wherein the sewer pipe 11 is connected to the tank 26 by the stand pipe coupler 12 and a relatively tall stand pipe 71 is connected through the stand pipe coupler 12 so that fluid from the sewer pipe 11 will not pass in the tank until it has passed up the stand pipe 71 and overflows into the tank 25.

Figure 3:
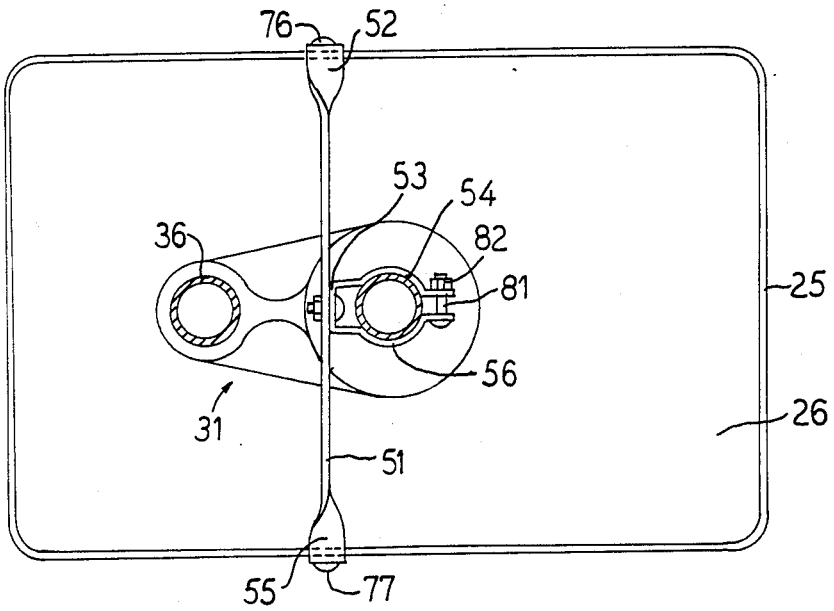
FIG. 3 is a top plan view of the invention.

So as to provide rigidity to the sump pump, a cross bracket 51 may have its opposite ends 52 and 55 connected to opposite walls of the tank 25 by bolts 76 and 77 which carry nuts on their inner ends. A bracket 53 has legs 54 and 56 which can be placed either around the upright 38 or the output pipe 36 of the sump pump and the legs 54 and 56 may be clamped together by a bolt 81 and nut 82 as shown in FIGS. 2 and 3, for example.

It is seen that the invention provides a novel sump pump installation which includes a tank and although it has been described with respect to preferred embodiments thereof, it is not to be so limited as changes and modifications can be made therein which are within the full intended scope as defined by the appended claims.

I claim as my invention:

1. A sump pump and tank for a pipe drain comprising, a tank with sidewalls and a bottom, means connecting said drain pipe to the tank so that liquid can flow from said drain pipe into said tank, and a sump pump mounted in said tank, a base and an inlet which rest on the bottom of said tank and provided with an outlet conduit so that fluid can be pumped from said tank, wherein said means connecting said drain pipe to said tank includes a stand pipe coupler, a nipple threadedly received in said stand pipe coupler and at least one threaded collar and a flexible gasket receivable on said nipple to seal the bottom of said tank to said drain pipe, wherein said sump pump has a vertical hollow member and a bracket which extends between opposite sides of said tank and across the top of said tank attached to said sides and to said vertical hollow member to lock said sump pump to said tank, said nipple has a length which extends upwardly into said tank, and wherein said sump pump has a float valve to turn it on when the liquid in said tank reaches a predetermined level.

* * * * *